US006334450B1

(12) United States Patent
Collis

(10) Patent No.: US 6,334,450 B1
(45) Date of Patent: Jan. 1, 2002

(54) METHOD OF RETAINING HAIR

(76) Inventor: Harvey Edward Collis, 41 Lancaster Grove, London NW3 4HB (GB)

( * ) Notice: Subject to any disclaimer, the term of this patent is extended or adjusted under 35 U.S.C. 154(b) by 0 days.

(21) Appl. No.: 09/600,641

(22) PCT Filed: Jan. 19, 1999

(86) PCT No.: PCT/GB99/00164

§ 371 Date: Jul. 20, 2000

§ 102(e) Date: Jul. 20, 2000

(87) PCT Pub. No.: WO99/37179

PCT Pub. Date: Jul. 29, 1999

(30) Foreign Application Priority Data

Jan. 21, 1998 (GB) ..... 9801267

(51) Int. Cl.[7] ..... A45D 7/00
(52) U.S. Cl. ..... 132/210; 132/212
(58) Field of Search ..... 132/210, 211, 132/212, 226, 232, 237, 245, 273, 200; 54/78

(56) References Cited

U.S. PATENT DOCUMENTS 3,955,064 A * 5/1976 Demetrio et al. ..... 132/232
4,477,716 A * 10/1984 Thaler et al. ..... 132/232
4,834,118 A * 5/1989 Goeller ..... 132/211
4,984,591 A * 1/1991 Jacobi ..... 132/229
5,036,870 A * 8/1991 Edmark ..... 132/273
5,289,834 A * 3/1994 Lawrence ..... 132/273
5,806,538 A * 9/1998 Keltner ..... 132/210
5,832,938 A * 11/1998 Yabara ..... 132/210

FOREIGN PATENT DOCUMENTS

FR 524947 * 5/1921 ..... 132/273

* cited by examiner

*Primary Examiner*—Eduardo C. Robert
(74) *Attorney, Agent, or Firm*—Breiner & Breiner, L.L.C.

(57) ABSTRACT

A hair manipulation device and method, the device including an elongate member characterized by an exterior surface of roughness and resilience such that when the device is inserted into a lock of hair, the device entrains hairs within the lock and pulls the hairs into loops. The method involves manipulating a group of hairs to lie in a desired position and then differentially looping a plurality of hairs from the desired group through and/or around the group to an extent sufficient to hold the group in the desired position.

1 Claim, 1 Drawing Sheet

METHOD OF RETAINING HAIR

FIELD OF INVENTION

This invention relates to hair manipulation and to devices for assisting hair manipulation.

BACKGROUND OF THE INVENTION

Human hair grows. If left uncut, it can grow to quite a considerable length. While long hair may be considered attractive, it is sometimes inconvenient and accordingly those who have long hair often seek from time to time to restrain it in some way. The technique of manipulating individual locks of hair into one or more plaits and securing the end of the plait remote from the head against unravelling dates back to prehistoric times. So likewise does the use of one or more combs (the comb is a very early invention) to secure the hair in some sort of bundled or folded configuration. Over the centuries, an enormously wide variety of pins, clips, slides and other devices have been used to secure hair above a certain length in a desired configuration.

The use of such devices, while very common, does not always give the desired aesthetic effect. Often it is desired for the hair to be held in a given configuration without appearing to be so held. For this purpose, various pins and grips are known which are coloured to match the hair colour and which may be inserted in unobtrusive fashion, but inserting them skilfully so that they remain unobtrusive and, in particular, so that they do not tend to slip, either rendering them visible or no longer fulfilling their intended purpose, or both, requires skill and practice, as well, of course, as a supply of pins or clips.

SUMMARY OF THE INVENTION

I have now found that such is the mechanical strength of hair that relatively large locks of hair may be held in place by using relatively small quantities of hair to hold them in place. Such fixation is desirably not permanent, nor should it be accomplished by knotting small quantities of hair around larger locks of hair. However, by constructing a loosely tied configuration, hair may be held in place for an adequate length of time against the normal forces disturbing the lie of the hair such as normal movements of the head and without prejudicing the ability of the owner of the hair, or an assistant, to comb the hair out so that the individual hairs are no longer entangled to a degree holding the hair in a position otherwise than its natural fall.

According to a first feature of the present invention, there is provided a method of retaining hair in a desired configuration which comprises manipulating a group of hairs to lie substantially in the desired position and then solely differentially looping a plurality of hairs from that desired group, or lying adjacent that desired group, through and/or around the group to an extent solely sufficient to hold the group in the desired position when the manipulation is released.

Differential looping, i.e. producing a large number of differently lying loops each of perhaps one or two hairs, and of different lengths of loop extending through different pathways within the mass of hair it is desired to hold in place, can be effected simply by manual manipulation of individual hairs or groups of a few hairs, for example using some sort of hook or like device, but if a reasonable looking final result is to be achieved, it requires very considerable dexterity and a great deal of time, in particular to produce the desired semi-permanent holding effect. Numerous individual manipulation s are needed, and this is impractical. A further problem is that when manoeuvring individual hairs into loops and moving the end of the loop it is very easy to overstretch the hair and break it, which is undesirable. It is also difficult to achieve an even effect, i.e. an even visual appearance to the final structure.

Accordingly, and this constitutes a second feature of the present invention, I have developed a tool for effecting differential looping which can be used quickly and simply to achieve the desired result.

Thus, according to a second feature of the present invention, there is provided a hair manipulation tool consisting of an elongate member, preferably of constant cross-section, and which is characterised by an exterior surface of roughness and resilience such that when passed through a lock of hair in a direction substantially transverse to the direction of the hairs in that lock, it will entrain hairs within the lock and pull them into loops until the tension in each loop is insufficient to break the hair, but sufficient to release the loop from the surface of the elongate member and leave it in place as a loop extending along the path traversed by the elongate member.

If such an implement is passed through a lock of hair, its surface entrains hairs, pulls them into loops and then releases them once the tension increases past a certain point. This occurs many times as the implement is passed once through the lock, and repeated passes in different directions quickly produces within the body of the lock a complex multiply looped structure which, while releasable on firm but gentle manipulation of the lock is nevertheless sufficiently stable and load-bearing to hold the lock in a desired position for some time. The more the looping, the longer the time.

DETAILED DESCRIPTION OF PRESENTLY PREFERRED EMBODIMENTS

Figure 1:
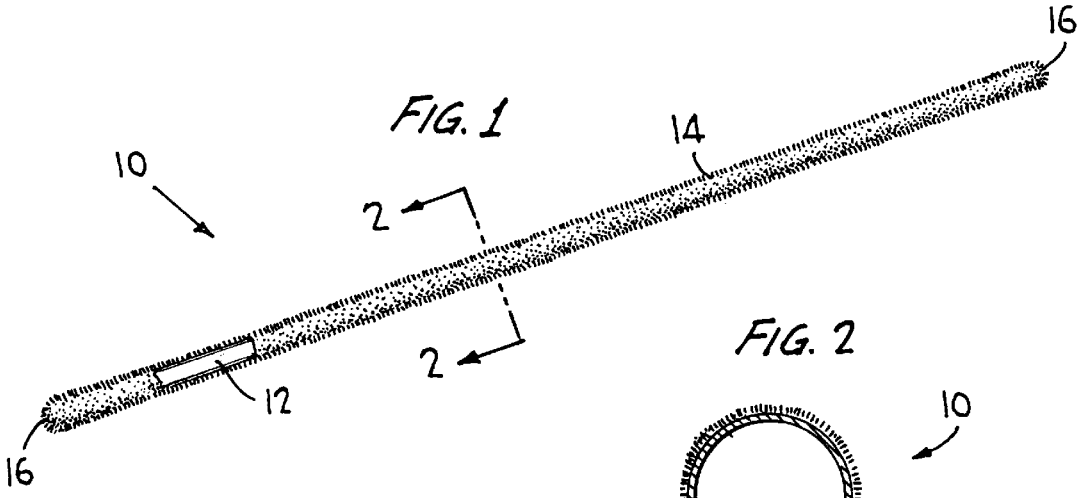
FIG. 1 is a perspective view of a hair manipulation tool having a constant cross-section and characterized by the features of this invention.

I have found that particularly good results may be achieved by implements 10 which consist of an elongate member 12 of generally rod-like form and having on its exterior surface a flock layer or coating 14.

The general dimensions of such a device are such as to enable it easily to be manipulated when it is desired to form loops in a head of hair to secure hair in place, and this generally means a rod 12 of length 10 to 20 centimeters and diameter 2 to 4 millimeters. A particularly convenient size is around 16 centimeters long and 3 to 4 millimeters in diameter.

Figure 2:
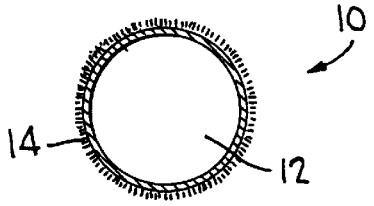
FIG. 2 is a cross-sectional view along line 2—2 of FIG. 1.
Figure 3A:
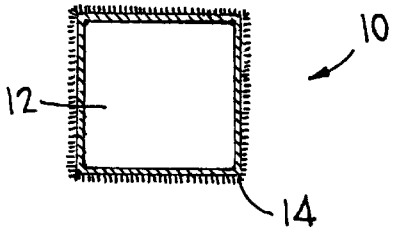
FIG. 3*a* is a cross-sectional view of a hair manipulation tool having a square cross-section and characterized by the features of this invention.
Figure 3B:
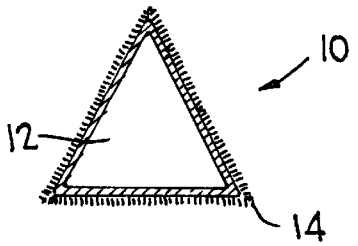
FIG. 3*b* is a cross-sectional view of a hair manipulation tool having a triangular cross-section and characterized by the features of this invention.
Figure 3C:
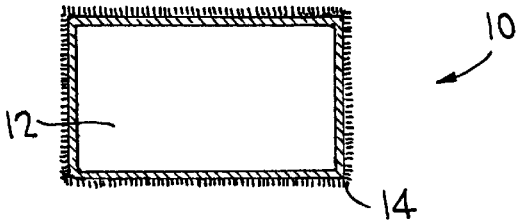
FIG. 3*c* is a cross-sectional view of a hair manipulation tool having a rectangular cross-section and characterized by the features of this invention.

The shape of the cross-section of the rod 12 may vary, though usually for manufacturing convenience it is circular or substantially so as shown at FIGS. 1 and 2. However, other shapes such as square, triangular or rectangular can easily be contemplated as shown in FIGS. 3*a*, 3*b* and 3*c*, respectively. If the cross-section is otherwise than round, a further feature is that the shape of the cross-section may rotate about the axis of the rod as the place where the cross-section is taken moves along the axis of the rod. If the cross-section is, for example, square, each of the four faces of the rod then has the shape of a helical strip. As such a rod is passed through a lock of hair, the rod tends to rotate about its long axis thus encouraging the loops it makes as it does so to be twisted rather than straight, so enhancing their holding effect.

The ends 16 of the rod 12 are conveniently tapered or rounded to permit easy insertion into a lock of hair and withdrawal therefrom. The rough surface may be achieved by any convenient process, a preferred surface being a so-called flock surface 14 which may be obtained by coating the exterior of a rod 12 with a suitable adhesive, applying short stiff fibers to the adhesive, and causing the adhesive to set, e.g. by thermal treatment or by the evaporation of solvent in that adhesive.

By using a rod 12 constructed in this way, it is possible to manipulate hair as indicated above to achieve a wide variety of holding effects, which nevertheless can be easily removed by combing gently.

What is claimed is:

1. A method of retaining hair in a desired configuration at a desired position which comprises manipulating a group of hairs to lie substantially in the desired position and then solely differentially looping a plurality of hairs from that desired group, or lying adjacent that desired group, through, around, or through and around the group to an extent solely sufficient to hold the group in the desired position, wherein the differential looping is achieved with the use of a hair manipulation tool consisting of an elongate member having a rough and resilient outer surface.

* * * * *